US011584614B2

(12) United States Patent
Witczak et al.

(10) Patent No.: US 11,584,614 B2
(45) Date of Patent: Feb. 21, 2023

(54) ELEVATOR SENSOR SYSTEM FLOOR MAPPING

(71) Applicant: Otis Elevator Company, Farmington, CT (US)

(72) Inventors: Tadeusz Pawel Witczak, Farmington, CT (US); Craig Drew Bogli, Avon, CT (US); Ezhil Nanjappan, Farmington, CT (US); Derk Oscar Pahlke, Berlin (DE); Yrinee Michaelidis, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1267 days.

(21) Appl. No.: 16/009,313

(22) Filed: Jun. 15, 2018

(65) Prior Publication Data

US 2019/0382237 A1 Dec. 19, 2019

(51) Int. Cl.

| | |
|---|---|
| ***B66B 1/34*** | (2006.01) |
| ***B66B 5/00*** | (2006.01) |
| ***B66B 3/00*** | (2006.01) |
| ***B66B 5/02*** | (2006.01) |

(52) U.S. Cl.
CPC ..... *B66B 5/0018* (2013.01); *B66B 1/3492* (2013.01); *B66B 3/002* (2013.01); *B66B 5/02* (2013.01)

(58) Field of Classification Search
CPC ..... B66B 5/0018; B66B 1/3492
See application file for complete search history.

(56) References Cited

U.S. PATENT DOCUMENTS

| | | | | |
|---|---|---|---|---|
| 3,973,648 | A | 8/1976 | Hummert et al. | |
| 5,035,301 | A | 7/1991 | Skalski | |
| 5,239,141 | A | 8/1993 | Tobita et al. | |
| 5,354,957 | A | 10/1994 | Robertson | |
| 5,412,163 | A * | 5/1995 | Tsuji | B66B 1/2408 187/382 |

(Continued)

FOREIGN PATENT DOCUMENTS

| | | | |
|---|---|---|---|
| CA | 291460 | A1 | 8/2017 |
| CN | 103889872 | A | 6/2014 |

(Continued)

OTHER PUBLICATIONS

EP Search Report; EP Application No. 19180693.4; Application Filed: Jun. 17, 2019; dated Dec. 17, 2019; 10 pages.

*Primary Examiner* — Christopher Uhlir
(74) *Attorney, Agent, or Firm* — Cantor Colburn LLP

(57) ABSTRACT

Methods and systems for determining elevator car locations are provided. Aspects includes a sensor affixed to a moving component of an elevator system, wherein the sensor is operated by a controller and wherein the controller is configured to determine that the elevator car is in motion based at least in part on the sensor. A direction of the elevator car is determined while the elevator car is in motion based at least in part on the sensor. Sensor data associated with the elevator car is collected while the elevator car is in motion, wherein the sensor data includes a travel time while the elevator car is in motion. Elevator car travel data is accessed from a travel time profile associated with the elevator car and the travel time is compared to the elevator car travel data to determine a location of the elevator car in a hoistway.

16 Claims, 5 Drawing Sheets

(56) References Cited

U.S. PATENT DOCUMENTS

| | | | | |
|---|---|---|---|---|
| 6,394,232 | B1 | 5/2002 | Iwata et al. | |
| 7,546,903 | B2 | 6/2009 | Kattainen et al. | |
| 7,740,111 | B2 | 6/2010 | Yoshikawa et al. | |
| 8,151,943 | B2 * | 4/2012 | de Groot | B66B 1/2458 187/382 |
| 8,397,874 | B2 | 3/2013 | De Groot | |
| 8,540,057 | B2 * | 9/2013 | Schuster | B66B 5/0006 187/247 |
| 8,584,813 | B2 | 11/2013 | Talonen et al. | |
| 9,745,170 | B2 | 8/2017 | Roussel | |
| 9,747,585 | B2 | 8/2017 | Eleid et al. | |
| 9,767,441 | B2 | 9/2017 | Eleid et al. | |
| 2021/0371233 | A1 * | 12/2021 | Kusserow | B66B 1/30 |

FOREIGN PATENT DOCUMENTS

| | | | | | |
|---|---|---|---|---|---|
| CN | 105417310 | A | | 3/2016 | |
| CN | 105705450 | A | | 6/2016 | |
| CN | 107235391 | A | | 10/2017 | |
| CN | 110606417 | A | | 12/2019 | |
| GB | 2007954 | A | | 12/1981 | |
| JP | H07215614 | A | | 8/1995 | |
| JP | 2011102158 | A | | 5/2011 | |
| JP | 2014005092 | A | * | 1/2014 | B66B 5/0025 |
| JP | 2014201411 | A | | 10/2014 | |
| WO | 2013030457 | A1 | | 3/2013 | |
| WO | 2019141598 | A1 | | 7/2019 | |

* cited by examiner

FIG. 4

400

404

| From / To | 1st floor | 2nd floor | 3rd floor | 4th floor | 5th floor |
|---|---|---|---|---|---|
| 1st floor | n/a | 15 seconds (2nd) | 21 seconds (calculated) | 27 seconds (calculated) | 33 seconds (calculated) |
| 2nd floor | 18 seconds (calculated) | n/a | 10 seconds (3rd) | 16 seconds (calculated) | 22 seconds (calculated) |
| 3rd floor | 25 seconds (calculated) | 10 seconds (calculated) | n/a | 10 seconds (4th) | 16 seconds (calculated) |
| 4th floor | 31 seconds (calculated) | 16 seconds (calculated) | 10 seconds (calculated) | n/a | 10 seconds (5th) |
| 5th floor | 33 seconds (1st) | 22 seconds (calculated) | 16 seconds (calculated) | 10 seconds (calculated) | n/a |

402

ELEVATOR SENSOR SYSTEM FLOOR MAPPING

BACKGROUND

The subject matter disclosed herein generally relates to elevator systems and, more particularly, to floor mapping using elevator sensors.

Elevator systems typically operate with a variety of sensors that are utilized to determine the position of an elevator car within a hoistway. At the same time, sensor data can be collected to predict maintenance needs and any changes to operating conditions. Sensor data collected from a variety of sensors is most useful when tied to a location of the elevator car within a hoistway.

BRIEF DESCRIPTION

According to one embodiment, a system is provided. The system includes a sensor affixed to a moving component of an elevator system, wherein the sensor is operated by a controller and wherein the controller is configured to determine that the elevator car is in motion based at least in part on the sensor. A direction of the elevator car is determined while the elevator car is in motion based at least in part on the sensor. Sensor data associated with the elevator car is collected while the elevator car is in motion, wherein the sensor data includes a travel time while the elevator car is in motion. Elevator car travel data is accessed from a travel time profile associated with the elevator car and the travel time is compared to the elevator car travel data to determine a location of the elevator car in a hoistway.

In addition to one or more of the features described above, or as an alternative, further embodiments of the system may include that the elevator car travel data comprises a plurality of origin-destination pair travel times for the elevator car in the hoistway.

In addition to one or more of the features described above, or as an alternative, further embodiments of the system may include that the plurality of origin-destination pair travel times for the elevator car in the hoistway comprise a first set of origin-destination pair travel times comprising actual travel times between a first set of floors serviced by the elevator car and a second set of origin-destination pair travel times comprising calculated travel times between a second set of floors serviced by the elevator car, wherein the calculated travel times are based at least in part on the actual travel times.

In addition to one or more of the features described above, or as an alternative, further embodiments of the system may include that the controller is further configured to collect, by the sensor, additional sensor data and associate the additional sensor data with the location of the elevator car in the hoistway.

In addition to one or more of the features described above, or as an alternative, further embodiments of the system may include that the additional sensor data includes vibration data for the elevator car.

In addition to one or more of the features described above, or as an alternative, further embodiments of the system may include that the controller is further configured to transmit an alert based on determining the vibration data for the elevator car exceeds a threshold.

In addition to one or more of the features described above, or as an alternative, further embodiments of the system may include that the alert includes the vibration data and the location of the elevator car in the hoistway.

In addition to one or more of the features described above, or as an alternative, further embodiments of the system may include that the sensor comprises an accelerometer.

In addition to one or more of the features described above, or as an alternative, further embodiments of the system may include that the elevator car travel data further comprises a confidence intervals for each of the plurality of origin-destination pair travel times for the elevator car in the hoistway.

In addition to one or more of the features described above, or as an alternative, further embodiments of the system may include that the controller is further configured to transmit an alert based on determining the travel time is outside the confidence interval for an origin-destination pair travel time.

According to one embodiment, a method is provided. The method includes determining, by a controller, that an elevator car is in motion based at least in part on a sensor. Determining a direction of the elevator car while the elevator car is in motion based at least in part on the sensor. Collecting, from the sensor, sensor data associated with the elevator car while the elevator car is in motion, wherein the sensor data includes a travel time while the elevator car is in motion. Accessing elevator car travel data from a travel time profile associated with the elevator car and comparing the travel time to the elevator car travel data to determine a location of the elevator car in a hoistway.

In addition to one or more of the features described above, or as an alternative, further embodiments of the method may include that the elevator car travel data comprises a plurality of origin-destination pair travel times for the elevator car in the hoistway.

In addition to one or more of the features described above, or as an alternative, further embodiments of the method may include that the plurality of origin-destination pair travel times for the elevator car in the hoistway comprise a first set of origin-destination pair travel times comprising actual travel times between a first set of floors serviced by the elevator car and a second set of origin-destination pair travel times comprising calculated travel times between a second set of floors serviced by the elevator car, wherein the calculated travel times are based at least in part on the actual travel times.

In addition to one or more of the features described above, or as an alternative, further embodiments of the method may include collecting, from the sensor, additional sensor data and associating the additional sensor data with the location of the elevator car in the hoistway.

In addition to one or more of the features described above, or as an alternative, further embodiments of the method may include that the additional sensor data includes vibration data for the elevator car.

In addition to one or more of the features described above, or as an alternative, further embodiments of the method may include transmitting an alert based on determining the vibration data for the elevator car exceeds a threshold.

In addition to one or more of the features described above, or as an alternative, further embodiments of the method may include that alert includes the vibration data and the location of the elevator car in the hoistway.

In addition to one or more of the features described above, or as an alternative, further embodiments of the method may include that the sensor comprises an accelerometer.

In addition to one or more of the features described above, or as an alternative, further embodiments of the method may include that the elevator car travel data further comprises a confidence intervals for each of the plurality of origin-destination pair travel times for the elevator car in the hoistway.

In addition to one or more of the features described above, or as an alternative, further embodiments of the method may include transmitting an alert based on determining the travel time is outside the confidence interval for an origin-destination pair travel time.

BRIEF DESCRIPTION OF THE DRAWINGS

The present disclosure is illustrated by way of example and not limited in the accompanying figures in which like reference numerals indicate similar elements.

FIG. 4 depicts a travel time profile according to one or more embodiments of the disclosure.

DETAILED DESCRIPTION

Figure 1:
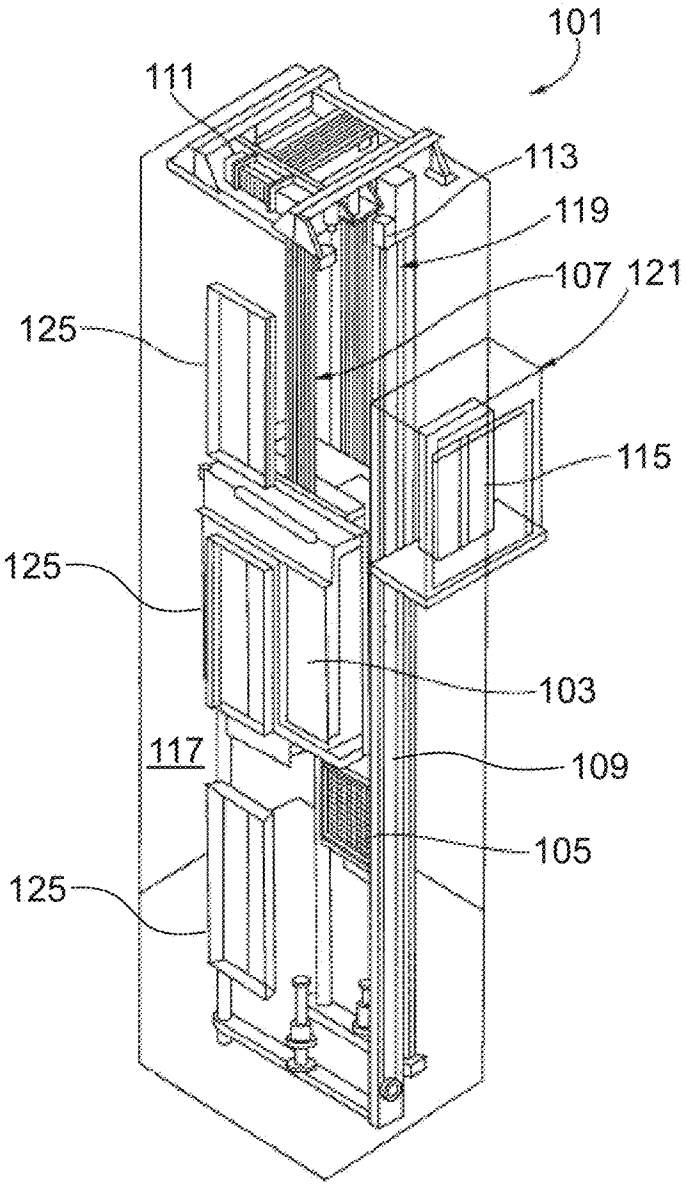
FIG. 1 is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft, such as hydraulic and/or ropeless elevators, may employ embodiments of the present disclosure. FIG. 1 is merely a non-limiting example presented for illustrative and explanatory purposes.

Figure 2:
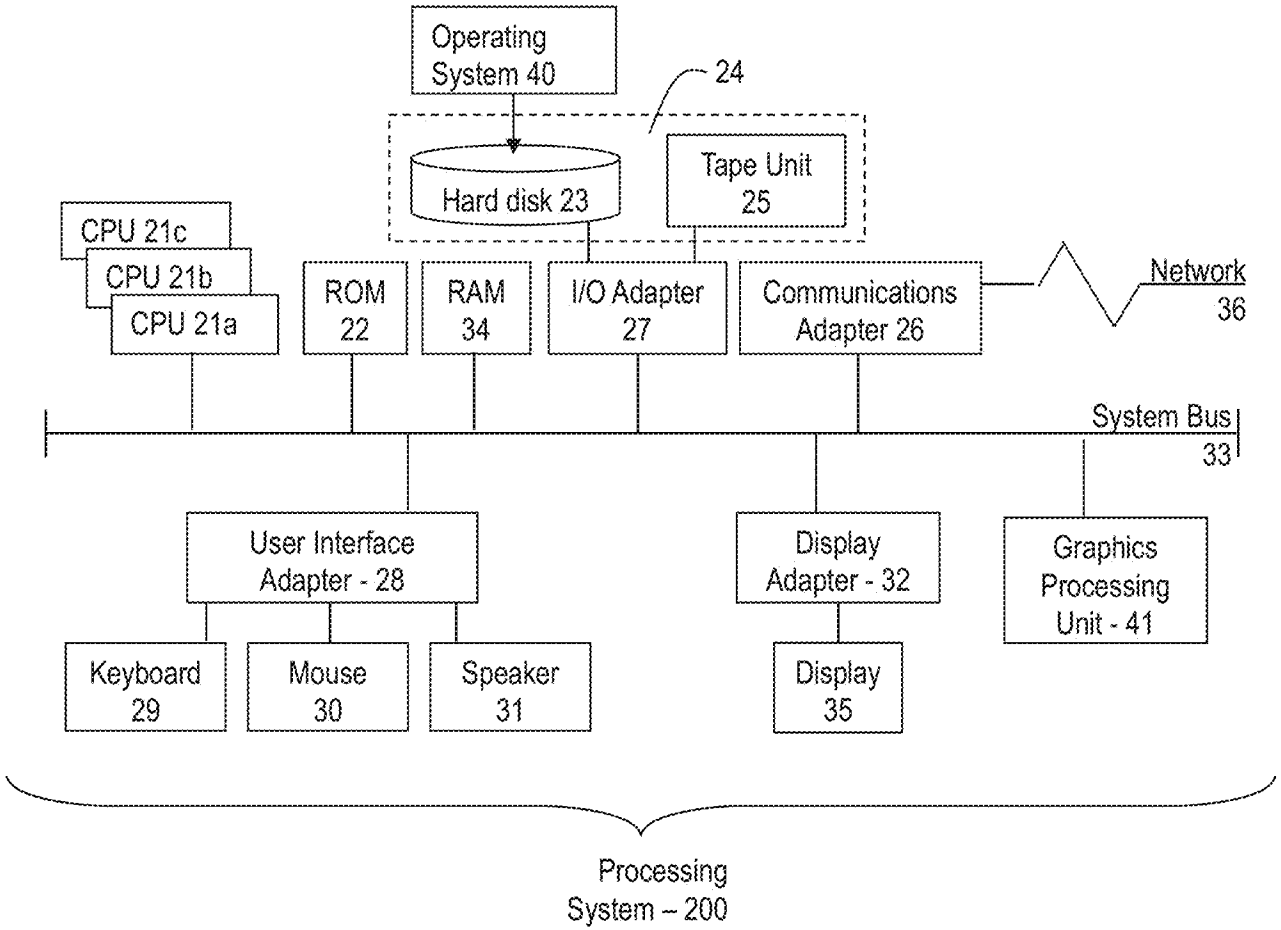
FIG. 2 depicts a block diagram of a computer system for use in implementing one or more embodiments of the disclosure.

Referring to FIG. 2, there is shown an embodiment of a processing system 200 for implementing the teachings herein. In this embodiment, the system 200 has one or more central processing units (processors) 21*a*, 21*b*, 21*c*, etc. (collectively or generically referred to as processor(s) 21). In one or more embodiments, each processor 21 may include a reduced instruction set computer (RISC) microprocessor. Processors 21 are coupled to system memory 34 (RAM) and various other components via a system bus 33. Read only memory (ROM) 22 is coupled to the system bus 33 and may include a basic input/output system (BIOS), which controls certain basic functions of system 200.

FIG. 2 further depicts an input/output (I/O) adapter 27 and a network adapter 26 coupled to the system bus 33. I/O adapter 27 may be a small computer system interface (SCSI) adapter that communicates with a hard disk 23 and/or tape storage drive 25 or any other similar component. I/O adapter 27, hard disk 23, and tape storage device 25 are collectively referred to herein as mass storage 24. Operating system 40 for execution on the processing system 200 may be stored in mass storage 24. A network communications adapter 26 interconnects bus 33 with an outside network 36 enabling data processing system 200 to communicate with other such systems. A screen (e.g., a display monitor) 35 is connected to system bus 33 by display adaptor 32, which may include a graphics adapter to improve the performance of graphics intensive applications and a video controller. In one embodiment, adapters 27, 26, and 32 may be connected to one or more I/O busses that are connected to system bus 33 via an intermediate bus bridge (not shown). Suitable I/O buses for connecting peripheral devices such as hard disk controllers, network adapters, and graphics adapters typically include common protocols, such as the Peripheral Component Interconnect (PCI). Additional input/output devices are shown as connected to system bus 33 via user interface adapter 28 and display adapter 32. A keyboard 29, mouse 30, and speaker 31 all interconnected to bus 33 via user interface adapter 28, which may include, for example, a Super I/O chip integrating multiple device adapters into a single integrated circuit.

In exemplary embodiments, the processing system 200 includes a graphics processing unit 41. Graphics processing unit 41 is a specialized electronic circuit designed to manipulate and alter memory to accelerate the creation of images in a frame buffer intended for output to a display. In general, graphics processing unit 41 is very efficient at manipulating computer graphics and image processing and has a highly parallel structure that makes it more effective than general-purpose CPUs for algorithms where processing of large blocks of data is done in parallel. The processing system 200 described herein is merely exemplary and not intended to limit the application, uses, and/or technical scope of the present disclosure, which can be embodied in various forms known in the art.

Thus, as configured in FIG. 2, the system 200 includes processing capability in the form of processors 21, storage capability including system memory 34 and mass storage 24, input means such as keyboard 29 and mouse 30, and output capability including speaker 31 and display 35. In one embodiment, a portion of system memory 34 and mass storage 24 collectively store an operating system coordinate the functions of the various components shown in FIG. 2. FIG. 2 is merely a non-limiting example presented for illustrative and explanatory purposes.

Turning now to an overview of technologies that are more specifically relevant to aspects of the disclosure, collection of elevator performance data can be useful for predicting maintenance needs for the elevator system. However, in order to help make elevator performance data as useful as possible for predicting these maintenance needs, the data should be coupled with specific locations of the elevator within the elevator hoistway. For example, determining the floor of a particular landing door that requires maintenance can be derived based on the elevator performance data tied to a specific location. Likewise, maintenance might want to know if poor door performance is linked to all landing doors, or specific landing doors. Typically, an elevator system can know at which floor an elevator is located by using a monitoring device capable of communicating with the elevator controller, or when there are added sensors in the hoistway to count which floor the elevator car is passing or landing on. However, installing these sensors in communication with an elevator controller can be expensive especially for existing elevator systems. There exists a need for an easy to install, low cost system that can determine the location of an elevator car within the elevator hoistway.

Turning now to an overview of the aspects of the disclosure, one or more embodiments address the above-described shortcomings of the prior art by providing an elevator car location sensing system utilizing a single sensor that can determine an elevator car location within a hoistway based on sensor data collected from the sensor. The system can utilize a sensor that can detect motion and direction of an elevator car in a hoistway. The system can create an elevator travel time profile that includes origin destination pair travel times for the elevator car. For example, an origin destination can be a first floor and a fifth floor. The elevator car can have an associated travel time for the elevator car to traverse the distance from the first floor to the fifth floor. Also, the elevator car can have a travel time to traverse the distance from the fifth floor to the first floor which can be different from the travel time from the first floor to the fifth floor. When an elevator car initiates a call and begins to move, the sensor can collect travel time data while the elevator car is in motion. This travel time data can be compared to the elevator travel time profile and the origin-destination pairs to determine the location of the elevator car in a hoistway.

Figure 3:
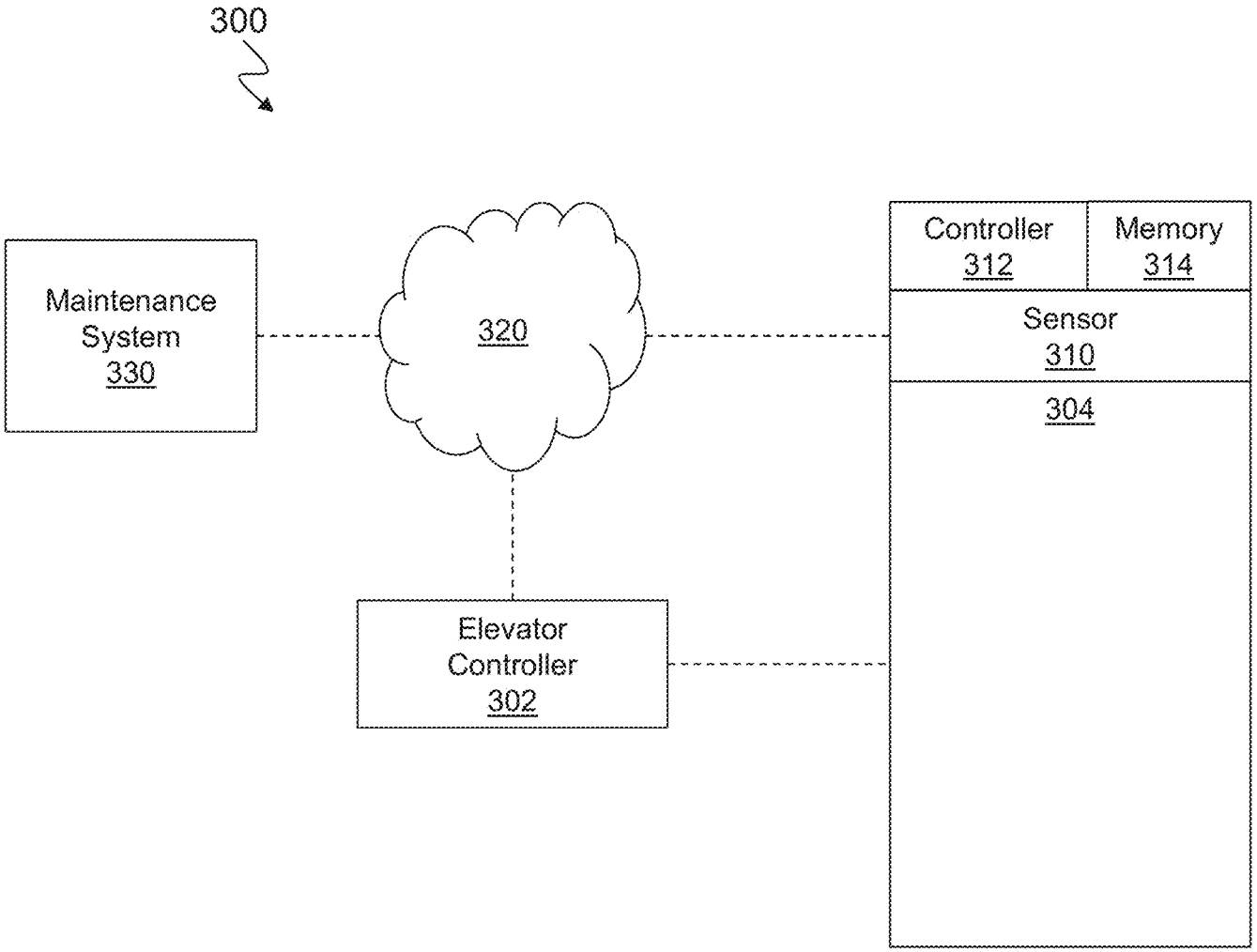
FIG. 3 depicts a block diagram of an elevator system with a sensor system for determining elevator car locations according to one or more embodiments of the disclosure.

Turning now to a more detailed description of aspects of the present disclosure, FIG. 3 depicts an elevator system 300 with a sensor system for determining elevator car locations. The system 300 includes an elevator controller 302, an elevator car 304, a network 320, and a maintenance system 330. Also, a sensor 310 for determining the location of the elevator car 304 in a hoistway in included in the elevator system 300. The sensor 310 includes a controller 312 and a memory 314.

In one or more embodiments, the elevator controller 302 and the controller 312 can be implemented on the processing system 200 found in FIG. 2. Additionally, a cloud computing system can be in wired or wireless electronic communication with one or all of the elements of the system 300. Cloud computing can supplement, support or replace some or all of the functionality of the elements of the system 300. Additionally, some or all of the functionality of the elements of system 300 can be implemented as a node of a cloud computing system. A cloud computing node is only one example of a suitable cloud computing node and is not intended to suggest any limitation as to the scope of use or functionality of embodiments described herein.

In one or more embodiments, the sensor 310 can be an internet of things (IoT) device. The term Internet of Things (IoT) device is used herein to refer to any object (e.g., an appliance, a sensor, etc.) that has an addressable interface (e.g., an Internet protocol (IP) address, a Bluetooth identifier (ID), a near-field communication (NFC) ID, etc.) and can transmit information to one or more other devices over a wired or wireless connection. An IoT device may have a passive communication interface, such as a quick response (QR) code, a radio-frequency identification (RFID) tag, an NFC tag, or the like, or an active communication interface, such as a modem, a transceiver, a transmitter-receiver, or the like. An IoT device can have a particular set of attributes (e.g., a device state or status, such as whether the IoT device is on or off, open or closed, idle or active, available for task execution or busy, and so on, a cooling or heating function, an environmental monitoring or recording function, a light-emitting function, a sound-emitting function, etc.) that can be embedded in and/or controlled/monitored by a central processing unit (CPU), microprocessor, ASIC, or the like, and configured for connection to an IoT network such as a local ad-hoc network or the Internet.

In one or more embodiments, the sensor 310 can be affixed to the elevator car 304. In another embodiment, the sensor 310 can be affixed to a moving component of the elevator system. For example, the sensor 310 can be affixed to a sheave or counterweight in an elevator system. In yet another embodiment, the sensor 310 can be affixed to the door header of the elevator car and positioned such that the sensor 310 can collect vibration data as the door of the elevator car 304 opens and closes. In one embodiment, the sensor 310 can be affixed to any desired location on the elevator car. In one or more embodiments, the sensor 310 includes three accelerometers that can collect movement data in a three dimensional plane defined by an x-axis, y-axis, and z-axis. This allows the sensor 310 to collect movement data of the elevator car 304, direction data of the elevator car 304, and vibration data when the elevator car 304 is operating. This movement, direction and vibration data can be stored in the memory 314. The controller 312 can analyze this data to determine the location of the elevator car 304 in a hoistway. In addition, the controller 312 can analyze the vibration data and couple the vibration data to the location of the elevator car 304 in the hoistway. The controller 312 can transmit an alert to the maintenance system 330 through the network 320 when the vibration data exceeds a threshold amount of vibrations. This threshold can be set by a maintenance person or building manager. The threshold can be a vibration magnitude that is compared to the measured vibration of the elevator car 304 by the sensor 310 In one or more embodiments, the controller 312 can transmit an alert to the elevator controller 302 to take an action with the elevator car 304 based on the vibration data collected by the sensor 310. In one or more embodiments, the controller 312 can take an action for the elevator car 304 based on the vibration data, the movement data, and direction data. Example actions include, but are not limited to, applying a brake to the elevator car 304, taking the elevator car 304 out of service, notifying maintenance personnel, notifying a building manager, and the like.

In one or more embodiments, the controller 312 can determine the location of the elevator car in the hoistway based on sensor data collected from the sensor 310 and a travel time profile associated with the elevator car 304. The travel time profile can be stored in the memory 314 and accessed by the controller 312 to compare to sensor data collected from the sensor 310. In one embodiment, the time profile can be stored in the elevator controller 302, cloud 320, maintenance system 330, or at any other desired location. FIG. 4 depicts a travel time profile 400 according to one or more embodiments. The travel time profile 400 includes origin-destination pairs with associated travel times between the origin-destination pair. In the illustrated example, the travel time from the first floor to the fifth floor in the travel time profile 400 is thirty-three (33) seconds. The travel time profile 400 is a non-limiting example for a five story building being serviced by an elevator car. In one or more embodiments, the travel time profile 400 can be populated by an elevator technician that can record the travel time as the elevator car travels to and from each and every floor in a building. However, this can be time consuming especially for tall buildings having several floors. In one or more embodiments, a first set of travel times 402 can be recorded for a first set of origin destination pairs in a building. This first set of floors can be equal to the number of floors in a building. In the illustrated example, the building is five floors and the first set of travel times 402 corresponds to the travel from the top ($5^{th}$) floor to the bottom ($1^{st}$) floor and then from the bottom floor to the second floor, the second floor to the third, and the third floor to the fourth floor. This sequence can be repeated for buildings having less than five floor and for building have more than five floors. A second set of travel times 404 for a second set of origin destination pairs can then be calculated from the first set of travel times. The initial travel from the top floor to the bottom floor allows for defining the elevator system rated speed. Logic can be utilized to support self-commissioning in the floor detection or figuring out if there is a mistake in the travel time profile 400. For example, when the elevator system 300 over time will periodically get lost. This means the elevator system 300 determines it is on floor 4 out of 5 and goes +2 (which is impossible as there are only 5 floors). When this occurs, the elevator system 300 needs to resets its new highest floor position to max floor 5 instead 6 that don't exist. Also, self-commissioning can be achieved in similar way. Just knowing the number of floors, the elevator system 300 can, after certain number of runs, map the building (without knowing the number of floors). For example, in a three story building, the elevator system 300 starts on unknown floor and labels it floor 1. If next run will be down we know it was not floor 1 but at least floor 2 and the new landing is now labelled floor 2. Next, the elevator car 304 travels up but for significantly shorter amount of time than it took for the previous time. This means that there is a stop between the earlier labelled floors and now the elevator system 300 determines that labelled floor 1 is actual floor 1. Also, the elevator system 300 discovers new floor 2 between floor 1 and old labelled floor 2, which it will then label floor 3. In that way after some time, the elevator system 300 can populate the travel time profile 400. In one or more embodiments, neural networks and statistical analysis can be added to the travel time calculation algorithms to help define what can be considered a lobby floor and which floors are basement floors.

In one or more embodiments, with one sensor 310 (for example, an acceleration sensor), information from additional sensors or inputs can be used to increase accuracy of the position calculation. (e.g. air-pressure, magnetometer, light sensor) Air-pressure can give an independent height information, magnetometer, light sensor and other will give trigger points at positions in the hoistway. Also, a learning specific sensor can collect information during travel. For example, an x, y sensor can collect accelerations that indicate specific rail unevenness to give additional height information between floors. In one or more embodiments, travel time data can be utilized as an indicator of elevator floor position. For example, the distance as the 2nd integration of the acceleration can be used to calculate the position. During hoistway tuning, the confirmation that the elevator is (after a certain travel time, distance) at a valid floor (landing) is confirmed by collecting additional information: e.g. door movement (specific vibration), correct acceleration, de-acceleration profile) and additional information (e.g., weight change, releveling, etc.) In one or more embodiments, the accuracy needed to judge about the floor is dependent on the floor to floor distance, numbers of floors and the elevator jerk, acceleration and speed. Typical floor distance is about 3 meters. Shorter landings less than 1 meter however are possible as well.

In one or more embodiments, the controller 312 can determine the elevator car 304 starts moving based on accelerometer data from the sensor 310. In one embodiment, this determination (or any of the determinations) can be made by the elevator controller 302, cloud 320, maintenance system 330, or at any other desired location. The direction (up/down) of the elevator car 304 is also determined by the controller 312 from the accelerometer data. The controller 312 stores the previous floor location in a memory 314 and uses this known floor location (e.g., starting point) to determine the destination floor of the elevator car by comparing the travel time to the starting point location. For example, from FIG. 4, should the elevator car 304 begin moving upwards from floor 2 and travel for 16 seconds, the controller 312 can determine that the elevator has stopped at floor 4. In one or more embodiments, the controller 312 can establish a confidence interval to determine floor location. For example, if the elevator car departs from floor 5 and travels for 24 seconds, the controller 312 can establish that the elevator car has stopped at floor 2 even though the travel time in the travel time profile lists the travel time as 22 seconds. The controller 312 can infer the elevator car 304 stops at floor 2 because the travel time is within a confidence interval for travel times (e.g., plus or minus 2 seconds). In one or more embodiments, major deviations in travel times can cause the controller 312 to alert a maintenance person to either perform maintenance on the elevator system and/or recalibrate the travel time profile for the elevator. For example, a confidence interval can be established for the travel time in the travel time profile. The confidence interval for a maintenance person can be values outside of plus or minus 2 seconds. In this case, the controller 312 may be unable to infer the floor location and would trigger a call to a maintenance person to investigate.

Figure 5:
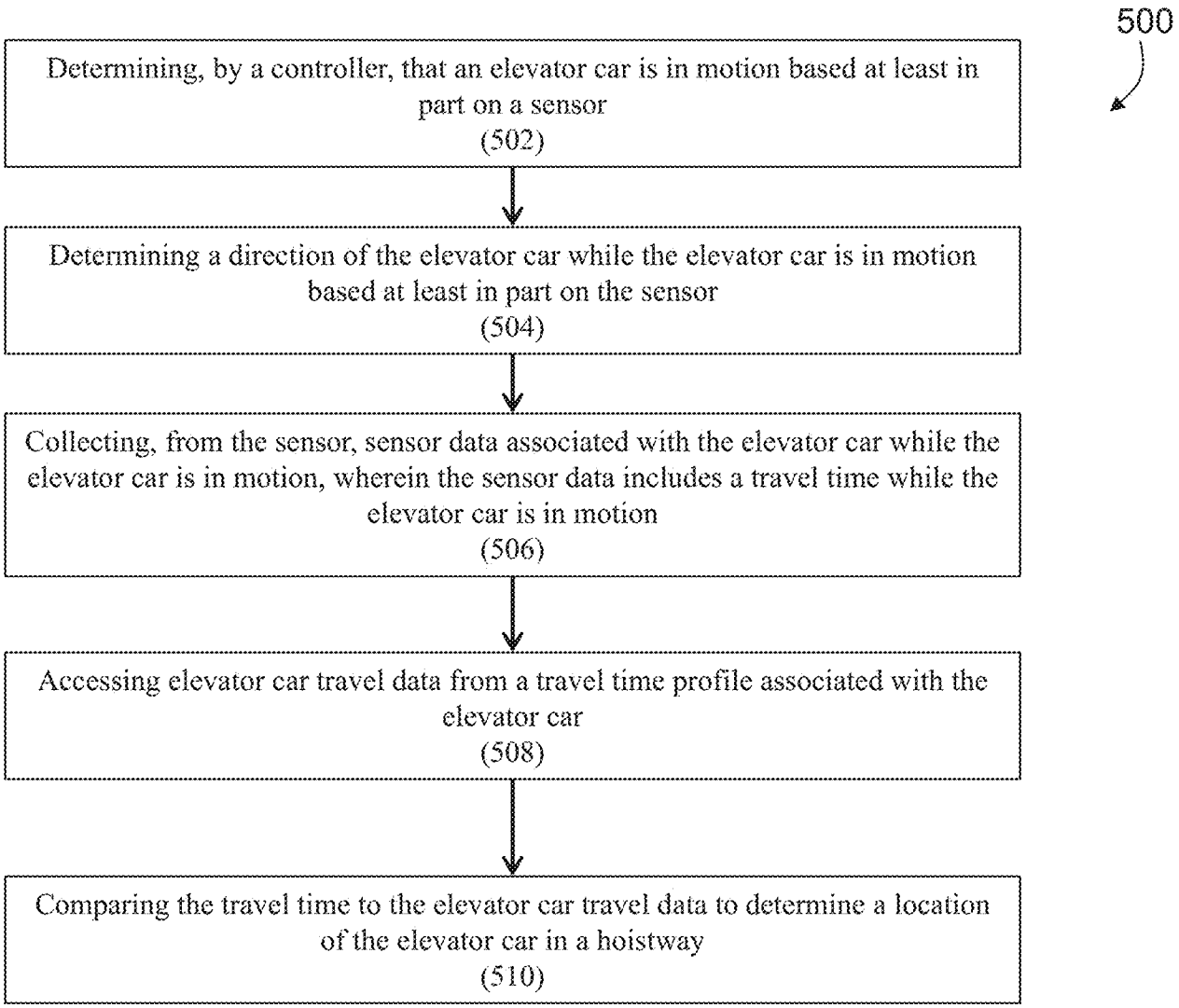
FIG. 5 depicts a flow diagram of a method for determining elevator car locations according to one or more embodiments of the disclosure.

FIG. 5 depicts a flow diagram of a method for determining elevator car locations according to one or more embodiments. The method 500 includes determining, by a controller, that an elevator car is in motion based at least in part on a sensor, as shown in block 502. At block 504, the method 500 includes determining a direction of the elevator car while the elevator car is in motion based at least in part on the sensor. The method 500, at block 506, also includes collecting, from the sensor, sensor data associated with the elevator car while the elevator car is in motion, wherein the sensor data includes a travel time while the elevator car is in motion. At block 508, the method 500 includes accessing elevator car travel data from a travel time profile associated with the elevator car. And at block 510, the method 500 includes comparing the travel time to the elevator car travel data to determine a location of the elevator car in a hoistway.

Additional processes may also be included. It should be understood that the processes depicted in FIG. 5 represent illustrations and that other processes may be added or existing processes may be removed, modified, or rearranged without departing from the scope and spirit of the present disclosure.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for determining elevator car locations, the system comprising:

an elevator system having an elevator car configured to travel between floors of a building along a hoistway; and a sensor affixed to a moving component of the elevator system, wherein the sensor is operated by a controller; and wherein the controller is configured to:

determine that the elevator car is in motion based at least in part on the sensor;

determine a direction of motion of the elevator car while the elevator car is in motion based at least in part on the sensor;

collect, from the sensor, sensor data associated with the elevator car while the elevator car is in motion, wherein the sensor data includes a travel time while the elevator car is in motion;

perform a self-commissioning operation and generate a travel time profile, wherein a number of floors of the building are not known prior to starting the self-commissioning operation access elevator car travel data from the travel time profile associated with the elevator car, wherein the travel time profile comprises a plurality of origin-destination pair travel times for the elevator car in the hoistway, wherein each origin and each destination of each origin-destination pair is a floor of the building, and wherein the plurality of origin-destination pair travel times comprises (i) a first set of origin-destination pair travel times comprising actual travel times between a first set of floors serviced by the elevator car and (ii) a second set of origin-destination pair travel times comprising calculated travel times between a second set of floors serviced by the elevator car, wherein the calculated travel times are based at least in part on the actual travel times; and compare the travel time to the elevator car travel data to determine a location of the elevator car in the hoistway.

2. The system of claim 1, wherein the controller is further configured to:

collect, by the sensor, additional sensor data; and associate the additional sensor data with the location of the elevator car in the hoistway.

3. The system of claim 2, wherein the additional sensor data includes vibration data for the elevator car.

4. The system of claim 3, wherein the controller is further configured to transmit an alert based on determining the vibration data for the elevator car exceeds a threshold.

5. The system of claim 4, wherein the alert includes the vibration data and the location of the elevator car in the hoistway.

6. The system of claim 1, wherein the sensor comprises an accelerometer.

7. The system of claim 1, wherein the elevator car travel data further comprises a confidence interval for each of the plurality of origin-destination pair travel times for the elevator car in the hoistway.

8. The system of claim 7, wherein the controller is further configured to transmit an alert based on determining the travel time is outside the confidence interval for an origin-destination pair travel time.

9. A method for determining elevator car locations, the method comprising:

determining, by a controller, that an elevator car is in motion along a hoistway based at least in part on a sensor;

determining a direction of the elevator car while the elevator car is in motion based at least in part on the sensor;

collecting, from the sensor, sensor data associated with the elevator car while the elevator car is in motion, wherein the sensor data includes a travel time while the elevator car is in motion;

performing a self-commissioning operation to generate a travel time profile, wherein a number of floors of the hoistway are not known prior to starting the self-commissioning operation;

accessing elevator car travel data from the travel time profile associated with the elevator car, wherein the travel time profile comprises a plurality of origin-destination pair travel times for the elevator car in the hoistway, wherein each origin and each destination of each origin-destination pair is a floor of the building, and wherein the plurality of origin-destination pair travel times comprises (i) a first set of origin-destination pair travel times comprising actual travel times between a first set of floors serviced by the elevator car and (ii) a second set of origin-destination pair travel times comprising calculated travel times between a second set of floors serviced by the elevator car, wherein the calculated travel times are based at least in part on the actual travel times; and comparing the travel time to the elevator car travel data to determine a location of the elevator car in the hoistway.

10. The method of claim 9 further comprising:

collecting, from the sensor, additional sensor data; and associating the additional sensor data with the location of the elevator car in the hoistway.

11. The method of claim 10, wherein the additional sensor data includes vibration data for the elevator car.

12. The method of claim 11 further comprising transmitting an alert based on determining the vibration data for the elevator car exceeds a threshold.

13. The method of claim 12, wherein alert includes the vibration data and the location of the elevator car in the hoistway.

14. The method of claim 9, wherein the sensor comprises an accelerometer.

15. The method of claim 9, wherein the elevator car travel data further comprises a confidence interval for each of the plurality of origin-destination pair travel times for the elevator car in the hoistway.

16. The method of claim 15, further comprising transmitting an alert based on determining the travel time is outside the confidence interval for an origin-destination pair travel time.

* * * * *